United States Patent [19]

Nakayama

[11] 4,249,064

[45] Feb. 3, 1981

[54] HEAT FIXING DEVICE FOR ELECTROGRAPHIC APPARATUS

[75] Inventor: Shigeru Nakayama, Hachioji, Japan

[73] Assignee: Olympus Optical Co. Ltd., Tokyo, Japan

[21] Appl. No.: 26,761

[22] Filed: Apr. 3, 1979

[30] Foreign Application Priority Data

May 29, 1978 [JP] Japan ..... 53/63250

[51] Int. Cl.[3] ..... H05B 1/00

[52] U.S. Cl. ..... 219/216; 219/388

[58] Field of Search ..... 219/216, 388; 355/3 FU; 432/59, 227; 250/316-319

[56] References Cited

U.S. PATENT DOCUMENTS

| | | | |
|---|---|---|---|
| 4,034,188 | 7/1977 | Takiguchi | 219/216 |
| 4,049,947 | 9/1977 | Bestenreiner et al. | 219/216 |

*Primary Examiner*—C. L. Albritton

*Attorney, Agent, or Firm*—Haseltine, Lake & Waters

[57] ABSTRACT

A heat fixing device for electrographic apparatus comprising a pair of opposed electrically conductive guide members between which passes a record sheet with a toner image transferred thereon, a floating potential or bias voltage being applied to at least one of the guide members so as to produce a repulsive force which can alleviate an electrical attractive force subjected between the guide member and the toner image on the record sheet.

5 Claims, 8 Drawing Figures

HEAT FIXING DEVICE FOR ELECTROGRAPHIC APPARATUS

BACKGROUND OF THE INVENTION

1. Field of the Invention

This invention relates to a heat fixing device for electrographic apparatus or the like.

2. Description of the Prior Art

Various kinds of electrographic apparatuses have been proposed and used in practice.

In a conventional electrographic apparatus, a photosensitive drum coated thereon with a photoconductor such as Se, ZnO or the like is rotated, charged with a corona source of ions, exposed, the charge image developed, the developed image transferred to a record sheet, and finally the toner image is fixed, generally by fusing. After the transfer operation, the residual image is erased from the surface of the photoconductor and the photoconductor is cleaned in preparation of a repetition of the process.

In the above described electrographic apparatus, the heat fixing device is provided with a pair of opposed guide members spaced apart from each other to form a record sheet feeding path and a pair of opposed supply sources spaced apart from each other to include therebetween the guide members. Alternatively, one heat supply source only may be opposed to the toner image transferred to the record sheet. The guide members and heat supply sources are supported by a supporting frame of the electrographic apparatus.

As the heat supply source, use may be made of a nichrome heater, halogen lamp, infrared lamp or the like. The guide members may generally be formed of a metal plate, metal wire with or without coated with an insulating substance.

In such kind of heat fixing device, the metal guide member is connected directly or through the metal supporting frame to ground. As a result, if the record sheet with the toner image transferred thereon reaches between the guide members, an electric attractive force is applied between the record sheet and one of the guide members and the record sheet is easily brought into contact with the guide member. The more the amount of the toner particles adhered to the record sheet the stronger the electrical attractive force.

Particularly, if the toner image side of the record sheet makes contact with the guide member, the toned image is rubbed with the guide member to disturb the picture image. If the record sheet is adhered to the guide member by the adhesive property of the toner particles, there is a risk of the record sheet being clogged and eventually being burnt.

If the guide member is formed of a heat resistant insulating material, the electric attractive force thereof can be made small. But, it is very difficult to provide a guide member which has an excellent guiding action along a relatively long feeding path and which is less expensive and has an excellent heat resistant insulating property.

SUMMARY OF THE INVENTION

An object of the invention, therefore, is to provide a heat fixing device for electrographic apparatus which can eliminate the above mentioned drawback which has been encountered with the prior art techniques, that is, which can effectively feed a record sheet without making at least the toner image side thereof contact with a guide member and without damaging the toner image, without clogging nor burning the record sheet.

A feature of the invention is the provision of a heat fixing device for electrographic apparatus comprising a pair of opposed electrically conductive guide members spaced apart from each other to form a feeding path for a record sheet and at least one heat supply source for fixing a toner image formed on the record sheet by electrically charged thermoplastic particles by fusing, characterized by comprising an electrical means for reducing an attractive force produced between at least that guide member which is opposed to the toner image formed on the record sheet on the one hand and the record sheet on the other hand.

Further objects and features of the invention will be fully understood from the following detailed description with reference to the accompanying drawings, in which:

DETAILED DESCRIPTION OF THE PREFERRED EMBODIMENTS

Figure 1:
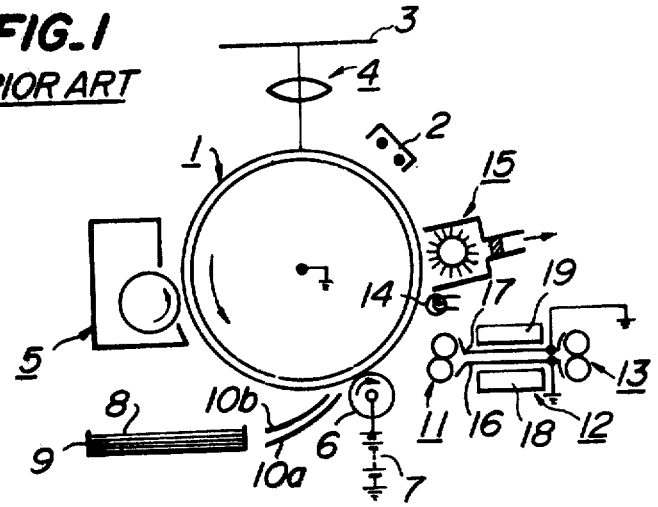
FIG. 1 PRIOR ART
FIG. 1 is a diagrammatic view of a conventional heat fixing device for electrographic apparatus.

FIG. 1 shows a conventional heat fixing device for electrographic apparatus. Referring to FIG. 1, reference numeral 1 designates a photosensitive drum having a surface coated with a photoconductor such as Se, ZnO or the like. The photosensitive drum 1 is rotated in a direction shown by an arrow. In the first place, the surface of the photosensitive drum 1 is uniformly charged with a positive polarity, for example, by means of a corona charge device 2. Then, the photosensitive drum 1 is illuminated with a light image of a manuscript 3 through an optical system 4 to produce, on the photosensitive drum 1, an electrostatic latent image corresponding to the manuscript image. This electrostatic latent image is developed by negatively charged toner particles in a developing device 5 into a visible toned image. The toner image is transferred from the photosensitive drum 1 to a record sheet 8 urged against the photosensitive drum 1 by means of a transfer roller 6. The transfer roller 6 is connected through a bias voltage source 7 to ground so as to apply a bias voltage having a polarity opposite to that of the charge of the toner particles, that is, a positive polarity to the transfer roller 6.

The record sheets 8 are enclosed and superimposed one upon the other in a cassette 9 and are picked up one by one by a feeding device (not shown) in synchronism with the rotation of the photosensitive drum 1. The record sheet 8 passes between guide plates 10*a*, 10*b* and is fed between the photosensitive drum 1 and the transfer roller 6. The record sheet 8 with the toner image transferred thereon is separated from the photosensitive drum 1 by means of a peeling off device (not shown) and then bitten between a pair of feed rollers 11, 11 and subsequently fed to a heat fixing device 12 which functions to fix the toner image by heating. The record sheet 8 thus fixed is delivered through a pair of outlet rollers 13 to the outside of the electrographic apparatus.

The photosensitive drum 1 which has transferred the toner image to the record sheet 8 is illuminated with an erasing lamp 14 to erase residual charge on the photosensitive drum 1. Then, residual toner particles on the photosensitive drum 1 are removed by a cleaning device 15, and as a result, the photosensitive drum 1 becomes ready for next copying operation.

In the above mentioned conventional electrographic apparatus, the heat fixing device 12 comprises a pair of opposed guide members 16, 17 separated from each other to form a record sheet feeding path therebetween and a pair of opposed heat supply sources 18, 19 each arranged at that side of the guide member which is opposite to the record medium 8. Alternatively, the heat fixing device 12 may include the heat supply source 19 only which is opposed to the toner image on the record sheet 8. The guide members 16, 17 and heat supply sources 18, 19 may be mounted on a supporting frame (not shown) of the apparatus.

The heat supply sources 18, 19 may be composed of a nichrome heater, halogen lamp, infrared lamp or the like. The guide members 16, 17 may be composed of a metal plate, metal wire or the like coated with or without insulating material.

In such conventional heat fixing device 12, the metal guide members 16, 17 are connected directly or through the metal supporting frame of the apparatus to ground. As a result, if the record sheet 8 with the toner image transferred thereon arrives at between the guide members 16, 17, an electrical attractive force acts between the record sheet 8 and one of the guide members 16, 17 and hence the record sheet 8 tends to be made contact with such guide member 16 or 17. The larger the amount of the toner particles adhered to the record sheet 8 the stronger the electrical attractive force.

Particularly, if the toner image side of the record sheet 8 makes contact with the guide member 17 located at the toner image side of the record sheet 8, the toner image is rubbed with the guide member 17. In addition, the adhesive property of the toner particles causes the record sheet 8 to adhere to the guide member 17, thereby clogging or eventually burning the record sheet 8.

It is possible to alleviate the electrical attractive force by forming the guide members 16, 17 with heat resistant insulating material only. But, it is very difficult to manufacture a guide member which functions to smoothly guide the record sheet along a relatively long feeding path and which is cheap and has an excellent heat resistant insulating property.

Figure 2:
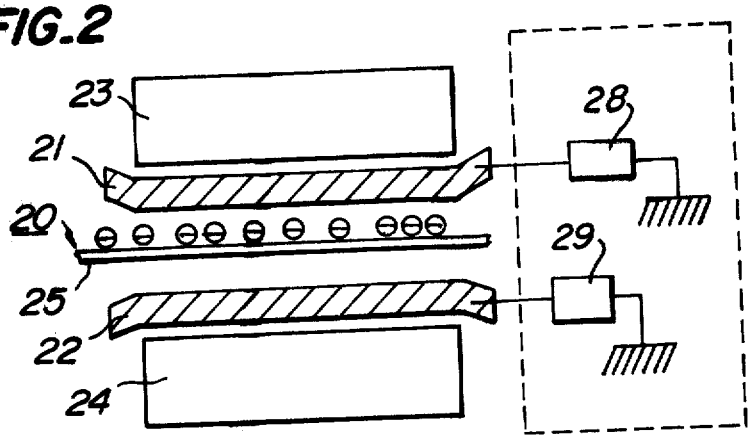
FIG. 2 is a diagrammatic view of one embodiment of a heat fixing device according to the invention in an enlarged scale.

FIG. 2 shows one embodiment of a heat fixing device for electrographic apparatus according to the invention. In the present embodiment, a heat fixing device 20 effectively useful for the electrographic apparatus shown in FIG. 1 comprises a pair of opposed electrically conductive guide members 21, 22 spaced apart from each other to form a feeding path for a record sheet 25 therebetween and a pair of opposed heat supply sources 23, 24 spaced apart from each other and located at that side of the guide member which is opposite to the record sheet 25.

In the present embodiment, the guide members 21, 22 are connected to ground so as to produce a floating potential thereon. The floating potential may easily be produced on the guide members by connecting them through an insulating member 28 and 29 to ground. As a result, it is possible to make the electrical attractive force acting between the guide members 21, 22 and the record sheet 25 small and hence to smoothly feed the record sheet 25 between the guide members 21, 22 without disturbing the toned image.

Figure 3:
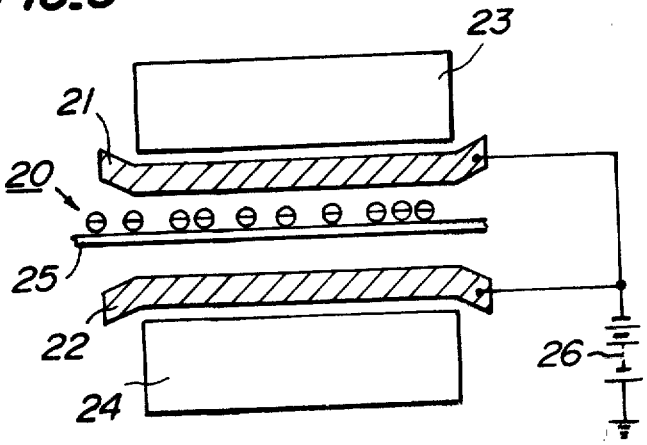
FIG. 3 is a similar view illustrating another embodiment of a heat fixing device for electrographic apparatus according to the invention.

FIG. 3 shows another embodiment of a heat fixing device for electrographic apparatus according to the invention. In a heat fixing device 20 of the present embodiment, between electrically conductive guide members 21, 22 and ground is connected a bias voltage source 26 so as to apply to guide members 21, 22 a given potential having a polarity which is the same as that of the potential of the record sheet 25.

As a result, it is possible to cause the electrical repulsive force to act between the record sheet 25 and the guide members 21, 22 and hence to feed the record sheet 25 in a smooth manner without disturbing the toner image.

Figure 4A:
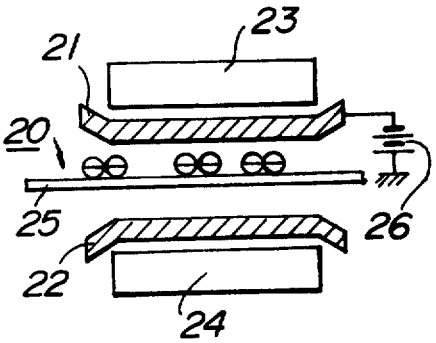
FIGS. 4*a–b*, 5, and 6*a–b* are similar views illustrating further enmbodiments of a heat fixing device for electrographic apparatus according to the invention.
Figure 4B:
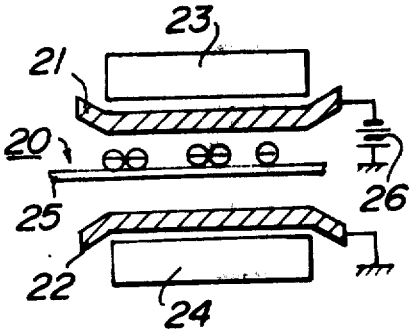
Figure 5:
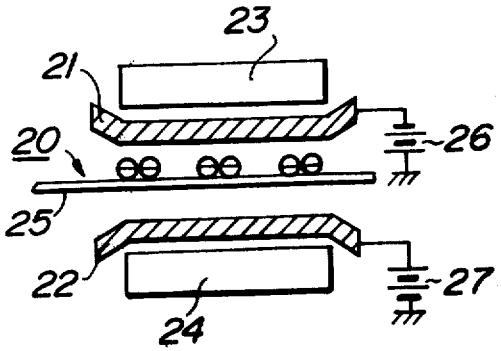

Alternatively, the bias voltage source 26 may be connected to the guide member 21 only which is opposed to the toned image on the record sheet 25 as shown in FIGS. 4A, 4B and 5 so as to apply the guide member 21 a given potential having a polarity which is the same as that of the record sheet 25. The guide member 22 which is not opposed to the toned image may not be connected to ground (FIG. 4A) so as to produce a floating voltage thereon or may be connected to ground (FIG. 4B) or may be connected through a second bias voltage source 27 to ground (FIG. 5). In these cases, it is also possible to cause the electrical repulsive force to act between the record sheet 25 and the guide member 21 and hence prevent the toner image side of the record sheet 25 from being made contact with the guide member 21. As a result, the record sheet 25 can be fed while making contact with the guide member 22 which is located at that side which is not opposed to the toner image. Thus, it is possible to effectively prevent damage of the toner image, clogging of the record sheet due to adhering property of the toner and burning or the like due to such clogging of the record sheet.

Figure 6A:
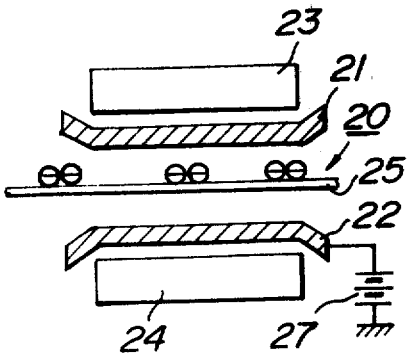
Figure 6B:
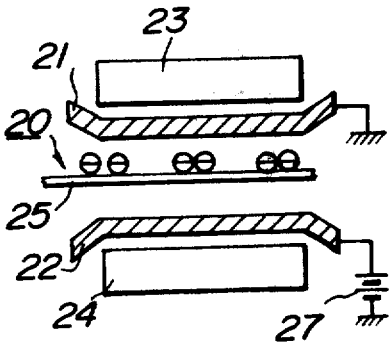

FIGS. 6A and 6B show another embodiments of a heat fixing device for electrographic apparatus according to the invention. In a heat fixing device 20 of the present embodiment, between electrically conductive guide member 22 which is not opposed to the toner image on the record sheet 25 and ground is connected a bias voltage source 27 so as to apply to the guide member 22 a given potential having a polarity which is opposite to that of the potential of the record sheet 25. A guide member 21 opposed to the toner image on the record sheet 25 may not be connected to ground so as to produce a floating potential thereon as shown in FIG. 6A or may be connected to ground as shown in FIG. 6B. Alternatively, the guide member 21 may be connected through a bias voltage source 26 to ground so as to apply the guide member 21 a given potential having a polarity which is the same as that of the potential of the record sheet 25 as shown in FIG. 5. As a result, it is possible to cause the electrical attractive force to act between the record sheet 25 and the guide member 22 which is not opposed to the toner image on the record sheet 25 and hence the record sheet 25 can slidably move along the guide member 22. There is no risk of the toner image on the record sheet 25 being brought into contact with the guide member 21, thereby feeding the record sheet 25 in a smooth manner.

As stated hereinbefore, the heat fixing device for electrographic apparatus according to the invention is capable of reducing the force for attracting the record sheet to the guide member which is opposed to the toned image in a simple manner by floating the guide member from ground potential or applying to the guide member a bias potential and hence is capable of smoothly feeding the record sheet and of effectively fixing the toner image to the record sheet by fusing. As a result, there is no risk of the toner image being damaged and there is no risk of the record sheet being clogged, burnt or the like. In addition, the invention can simply be applied to the conventional heat fixing device for electrographic apparatus without changing its construction.

The invention is not limited to the above mentioned embodiments, but may changes and modifications may be possible. For example, in the embodiments shown in FIGS. 2 and 3, the heat supply source may be located at that side only of the guide member which is opposed to the toner image of the record sheet.

In addition, the guide member may be formed of electrically conductive material only or the surface of the electrically conductive guide member may be coated with an insulating material. The heat fixing device according to the invention may be applied not only to the electrographic apparatus but also to any apparatus which can fix by fusing an image formed by electrically charged thermoplastic particles.

What is claimed is:

1. A heat fixing device for electrographic apparatus comprising a pair of opposed electrically conductive guide members spaced apart from each other to form a feeding path for a record sheet, and at least one heat supply source for fixing a toner image formed on the record sheet by electrically charged thermoplastic particles by fusing, characterized by comprising an electrical means for reducing an attractive force produced between at least that guide member which is opposed to the toner image formed on the record sheet on the one hand and the record sheet on the other hand.

2. The heat fixing device according to claim 1, wherein said electrical means is composed of means for floating at least that guide member which is opposed to the toner image formed on the record sheet from ground.

3. The heat fixing device according to claim 2, wherein said means for floating at least that guide member which is opposed to the toner image formed on the record sheet from ground is composed of an insulating member inserted between the guide member and ground.

4. The heat fixing device according to claim 1, wherein said electrical means is composed of means for applying a bias voltage to at least that guide member which is opposed to the toner image formed on the record sheet such that said guide member has a given potential having a polarity which is the same as that of the potential of the toner image formed on the record sheet.

5. The heat fixing device according to claim 1, wherein said electrical means is composed of means for applying a bias voltage to at least that guide member which is not opposed to the toner image formed on the record sheet such that said guide member has a guide potential having a polarity which is opposite to that of the potential of the toner image formed on the record sheet.

* * * * *